US009254654B2

(12) United States Patent
Yoshida

(10) Patent No.: US 9,254,654 B2
(45) Date of Patent: Feb. 9, 2016

(54) LIQUID DISCHARGING HEAD AND IMAGE FORMING APPARATUS INCLUDING SAME

(71) Applicant: Takahiro Yoshida, Ibaraki (JP)

(72) Inventor: Takahiro Yoshida, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/627,112

(22) Filed: Feb. 20, 2015

(65) Prior Publication Data

US 2015/0246536 A1 Sep. 3, 2015

(30) Foreign Application Priority Data

Mar. 3, 2014 (JP) ..... 2014-040994

(51) Int. Cl.
*B41J 2/14* (2006.01)

(52) U.S. Cl.
CPC ..... *B41J 2/1433* (2013.01)

(58) Field of Classification Search
CPC ..... B41J 2/1433
USPC ..... 347/47
See application file for complete search history.

(56) References Cited

U.S. PATENT DOCUMENTS

2006/0007272 A1 1/2006 Ogata et al.
2007/0080978 A1 4/2007 Yoshida
2007/0211092 A1 9/2007 Shingyohuchi et al.
2008/0117262 A1 5/2008 Mori et al.
2009/0102907 A1 4/2009 Yamanaka et al.
2009/0147034 A1 6/2009 Yoshida
2009/0289975 A1 11/2009 Yoshida
2011/0096113 A1 4/2011 Yoshida
2012/0236080 A1 9/2012 Yoshida et al.
2014/0210914 A1 7/2014 Yoshida et al.
2014/0232796 A1 8/2014 Yuu Kimura et al.

FOREIGN PATENT DOCUMENTS

JP 2011-016331 1/2011
JP 2012-183771 9/2012

OTHER PUBLICATIONS

U.S. Appl. No. 14/471,174, filed Aug. 28, 2014.

*Primary Examiner* — Stephen Meier
*Assistant Examiner* — Alexander D Shenderov
(74) *Attorney, Agent, or Firm* — Cooper & Dunham LLP

(57) ABSTRACT

A liquid discharging head includes a nozzles plate including a plurality of nozzles to discharge droplets; a channel plate including a plurality of individual liquid chambers disposed in a row and connected to the plurality of nozzles; a wall-forming member to form a wall of the individual liquid chambers; a plurality of dummy individual channels disposed on the channel plate along a nozzle alignment direction outside lateral ends of the row of individual liquid chambers; and partitions between the dummy individual channels. A width of the partitions between the dummy individual channels along the nozzle alignment direction increases away from the individual liquid chambers.

5 Claims, 6 Drawing Sheets

LIQUID DISCHARGING HEAD AND IMAGE FORMING APPARATUS INCLUDING SAME

CROSS-REFERENCE TO RELATED APPLICATION

The present application claims priority pursuant to 35 U.S.C. §119(a) from Japanese patent application number 2014-040994, filed on Mar. 3, 2014, the entire disclosure of which is incorporated by reference herein.

BACKGROUND

1. Technical Field

Exemplary embodiments of the present invention relate to a liquid discharging head and an image forming apparatus including the liquid discharging head.

2. Description of the Related Art

Among various types of image forming apparatuses including printers, facsimile machines, copiers, plotters, and multifunction apparatuses combining several capabilities of the above devices, there is an inkjet recording apparatus in which a recording head formed of a liquid discharging head (or a droplet discharge head) to discharge droplets is employed.

A conventional liquid discharging head includes a plurality of dummy liquid chambers disposed outboard of a line of individual liquid chambers that discharge droplets to position so that a inflection point of a bend in the channel plate outside the individual liquid chambers.

In a case in which stainless steel (SUS) or some other metal is used for the channel plate and individual channels such as pressure chambers or individual liquid chambers are formed by press working the sheet metal, the channel plate is polished to improve surface smoothness of the channel plate. However, during polishing, the partitions between the individual liquid chambers tend to be polished more, thereby causing a difference in the depth of the channel plate and causing bonding failures when bonding the channel plate to the nozzle plate.

SUMMARY

In one embodiment of the disclosure, there is provided an optimal liquid discharging head that includes a nozzles plate including a plurality of nozzles to discharge a liquid; a channel plate including a plurality of individual liquid chambers disposed in a row and connected to the plurality of nozzles; a wall-forming member to form a wall of the individual liquid chambers; a plurality of dummy individual channels disposed on the channel plate along a nozzle alignment direction outside lateral ends of the row of individual liquid chambers; and partitions between the dummy individual channels. A width of the partitions between the dummy individual channels along the nozzle alignment direction increases away from the individual liquid chambers.

In one embodiment of the disclosure, there is provided an optimal image forming apparatus including a liquid discharging head. The liquid discharging head includes a nozzles plate including a plurality of nozzles to discharge a liquid; a channel plate including a plurality of individual liquid chambers disposed in a row and connected to the plurality of nozzles; a wall-forming member to form a wall of the individual liquid chambers; a plurality of dummy individual channels disposed on the channel plate along a nozzle alignment direction outside lateral ends of the row of individual liquid chambers; and partitions between the dummy individual channels. A width of the partitions between the dummy individual channels along the nozzle alignment direction increases away from the individual liquid chambers.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described with reference to accompanying drawings.

Figure 1:
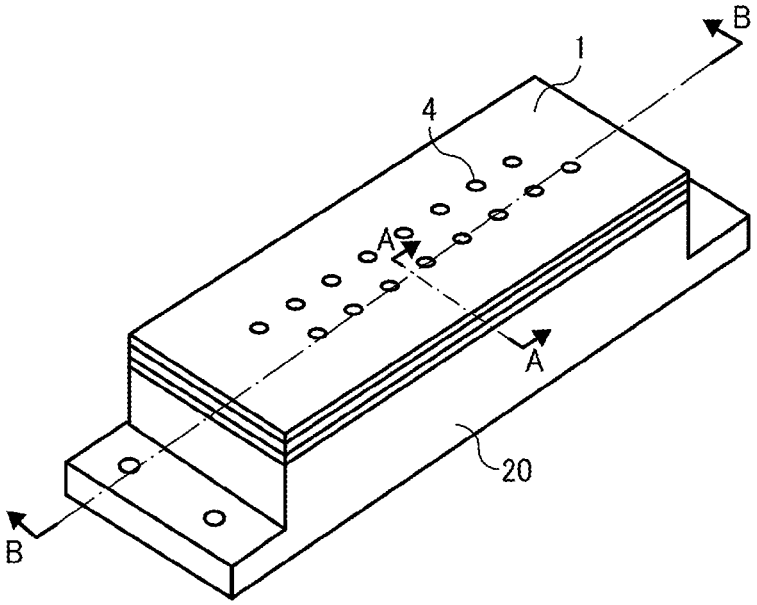
FIG. 1 is a schematic perspective view of a liquid discharging head according to an embodiment of the present invention.
Figure 2:
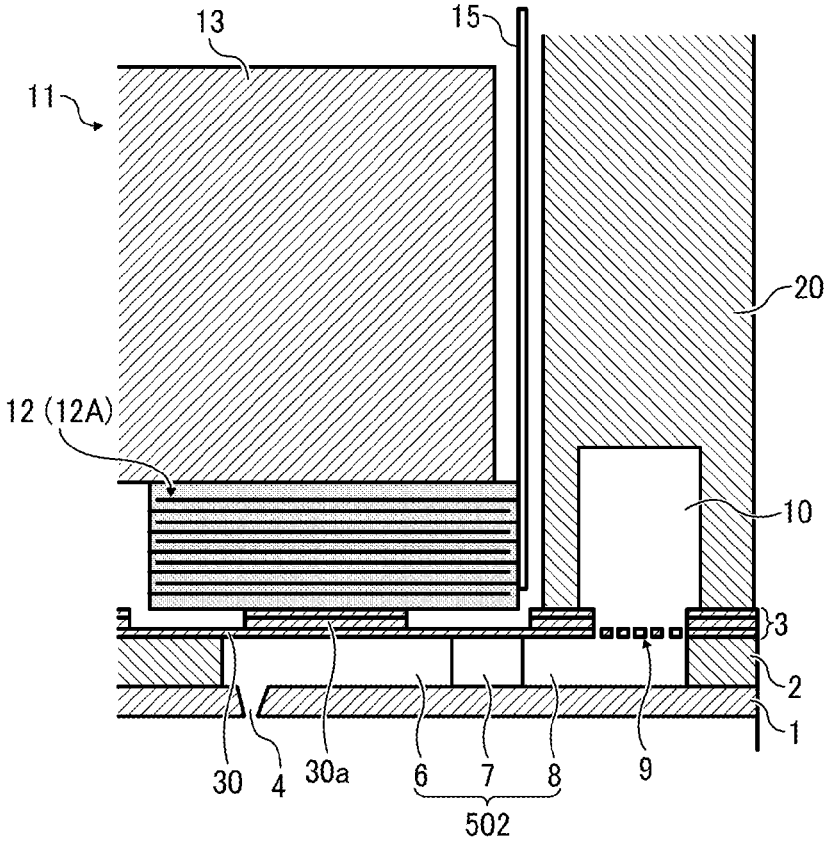
FIG. 2 is a cross-sectional view of the liquid discharging head along a line A-A in FIG. 1 perpendicular to a nozzle alignment direction.
Figure 3:
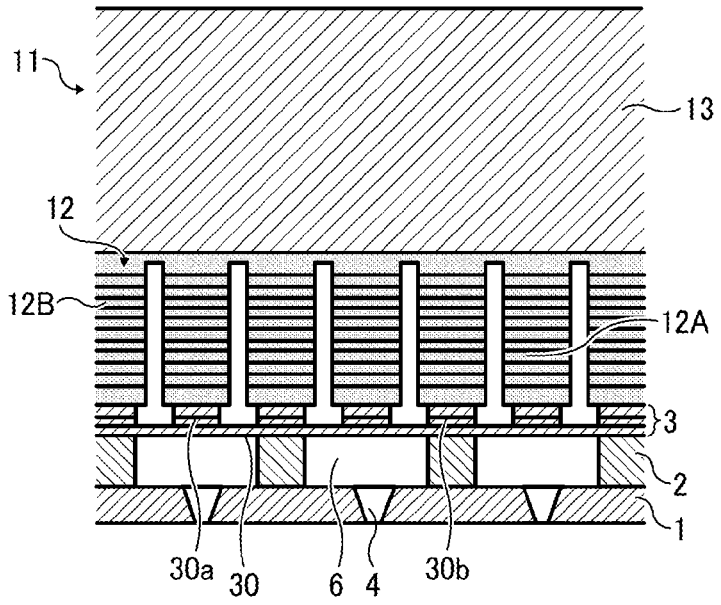
FIG. 3 is a cross-sectional view of the liquid discharging head along a line B-B in FIG. 1 in the nozzle alignment direction.

FIG. 1 is a schematic perspective view of a liquid discharging head. FIG. 2 is a cross-sectional view of the liquid discharging head along a line A-A in FIG. 1 perpendicular to a nozzle alignment direction, that is, along a longitudinal direction of a liquid chamber. FIG. 3 is a cross-sectional view of the liquid discharging head along a line B-B in FIG. 1 in the nozzle alignment direction, that is, along a short side of the liquid chamber.

This liquid discharging head includes a nozzle plate 1, a channel plate or a liquid chamber substrate 2, and a vibration plate 3 as a wall-forming member, laminated one on top other. The liquid discharging head further includes a piezoelectric actuator 11 that displaces the vibration plate 3 and a frame 20 that serves as a common channel member.

The nozzle plate 1, the channel plate 2, and the vibration plate 3 together form an individual channel 502, to which a plurality of nozzles 4 connects. The individual channel 502 includes an individual liquid chamber 6 to which each nozzle 4 connects from downstream, a fluid resistor 7 to supply liquid to the individual liquid chamber 6, and a liquid inlet 8 connected to the fluid resistor 7.

Liquid is introduced from a common liquid chamber 10 of the frame 20 via a supply port 9 formed at the vibration plate 3 to the individual channel 502, and is further supplied to the individual liquid chamber 6 through the liquid inlet 8 and the fluid resistor 7. The supply port 9 may be provided with a filter.

In the present embodiment, the nozzle plate 1 is formed of electroplated nickel (Ni). Alternatively, the nozzle plate can be formed from other metals, resins, or a laminated structure including a resin layer and a metal layer. The nozzle plate 1 includes, for example, a plurality of nozzles 4 each with a diameter of from 10 to 35 micrometers corresponding to each liquid chamber 6, and is bonded to the channel plate 2 with an adhesive. A water repellent layer is formed on a droplet discharging side of the nozzle plate 1, that is, on a reverse side of the individual liquid chamber 6.

A through-hole portion is formed on the channel plate 2 by etching a SUS substrate. The through-hole portion constructs the individual channel 502 including the individual liquid chamber 6, the fluid resistor 7, and the liquid inlet 8.

The vibration plate 3 is a wall-forming member of the wall of the individual liquid chamber 6 of the channel plate 2. The vibration plate 3 has a three-layered structure, in which a first layer adjacent to the channel plate 2 forms a vibration area 30 that is deformable corresponding to the individual liquid chamber 6.

Like the nozzle plate 1, the vibration plate 3 is formed of electroplated nickel (Ni). Alternatively, the nozzle plate can be formed from other metals, resins, or a laminated structure including a resin layer and a metal layer.

A piezoelectric actuator 11 including an electromechanical transduction element as a drive means (or an actuator or a pressure generating means) to deform the vibration area 30 of the vibration plate 3 is disposed on the opposite side of the individual liquid chamber 6 of the vibration plate 3. The piezoelectric actuator 11 includes a base member 13 and a multiple-layered piezoelectric member 12 laminated on the base member 13 with an adhesive. The piezoelectric member 12 is processed into grooves by half-cut dicing and a predetermined number of piezoelectric pillars 12A and 12B are formed in a sawtooth pattern at predetermined intervals with respect to one piezoelectric member 12.

The piezoelectric pillars 12A and 12B of the piezoelectric member 12 are materially the same, differing only in that the piezoelectric pillar which is driven by being supplied with a drive waveform serves as a driven pillar 12A and the piezoelectric pillar which is used only as a support pillar is a non-driven piezoelectric pillar 12B.

The driven pillar 12A is connected to an island-shaped convex portion 30*a* formed on the vibration area 30 of the vibration plate 3. The non-driven pillar 12B is connected to the island-shaped convex portion 30*b* formed on the vibration plate 3.

The piezoelectric member 12 is formed of a piezoelectric layer and an internal electrode that are alternately laminated. The internal electrode is drawn to an edge surface to provide an external electrode, to which an FPC 15, a flexible wiring substrate with flexibility to afford drive signals to the external electrode of the driven pillar 12A, is connected.

The frame 20 is formed using epoxy resins or thermally curable resins such as polyphenylene sulfide by injection molding, and the common liquid chamber 10 to which liquid is supplied from a head tank or a liquid supply cartridge, is disposed in the frame 20.

In the thus-configured liquid discharging head, if, for example, the voltage to be applied to the driven pillar 12A is lowered from the reference potential, the driven pillar 12A is contracted, the vibration area 30 of the vibration plate 3 is lowered, and the volume of the individual liquid chamber 6 is expanded, so that the liquid flows into the individual liquid chamber 6.

When the voltage to be applied to the driven pillar 12A is increased, the driven pillar 12A expands in the layered direction and the vibration area 30 of the vibration plate 3 is deformed toward the nozzle 4 to thus contract the volume of the individual liquid chamber 6. The liquid inside the individual liquid chamber 6 is compressed and a droplet is jet from the nozzle 4.

When the voltage applied to the driven pillar 12A returns to the reference potential, the vibration area 30 of the vibration plate 3 returns to an initial position, and the individual liquid chamber 6 expands to generate a negative pressure. At this time, the individual liquid chamber 6 is filled with the liquid from the common liquid chamber 10 via the supply channel. Then, after vibration of the meniscus surface of the nozzle 4 is damped and stabilized, the operation proceeds to a next droplet discharging.

The head driving method is not limited to the above example (pull-and-push jet), and alternatively a pull-jet or push-jet method can be adopted depending on the direction given by the driving waveform.

Figure 4:
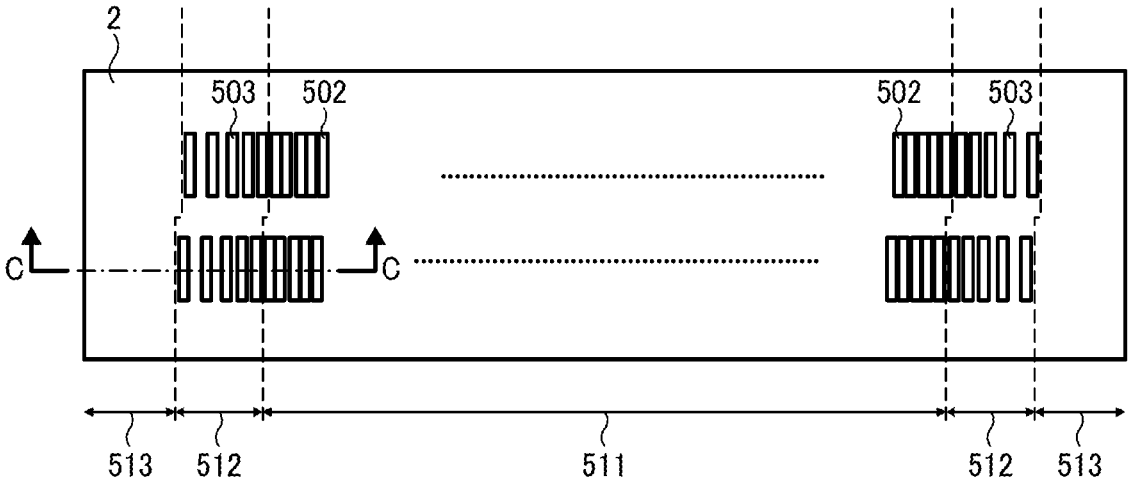
FIG. 4 is a plan view of a channel plate according to a first embodiment of the present invention.
Figure 5:
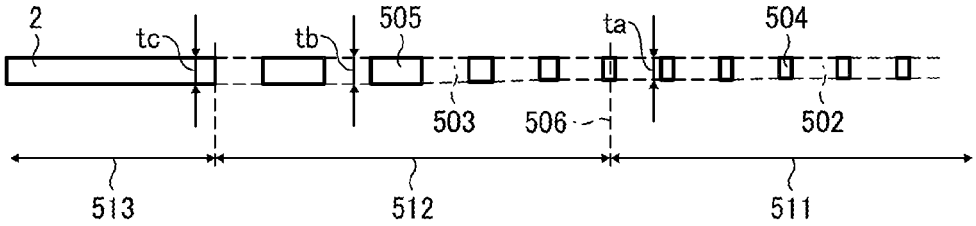
FIG. 5 is a cross-sectional view of the channel plate along a line C-C in FIG. 4.

Next, a first embodiment will be described with reference to FIGS. 4 and 5. FIG. 4 is a plan view of a channel plate according to a first embodiment. FIG. 5 shows a cross-sectional view of the channel plate along a line C-C in FIG. 4.

Rows of individual channels 502 including individual liquid chambers 6 are disposed on the channel plate 2 along the nozzle alignment direction.

A plurality of dummy individual channels 503 each having a shape similar to that of the individual channels 502 is disposed outside the lateral ends of the rows of individual channels 502 in the nozzle alignment direction.

Herein, in this description, an area in which the individual channel 502 is disposed is an individual channel area 511, an area in which the dummy individual channel 503 is disposed is a dummy individual channel area 512, and an area outside the dummy individual channel area 512 is an area 513 where the dummy individual channel 503 is not formed.

In the dummy individual channel area 512, the pitch between the adjacent dummy individual channels 503 widens away from the individual channel area 511. Put differently, partitions 505 between the dummy individual channels 503 widen along the nozzle alignment direction away from the individual channel area 511.

Figure 6:
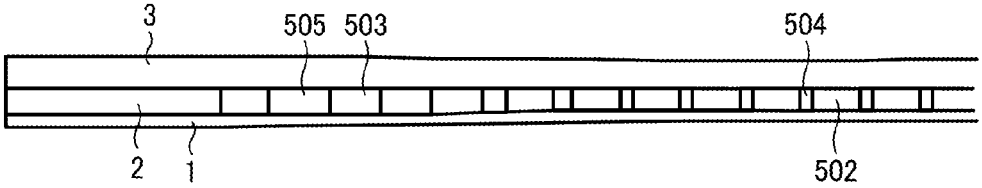
FIG. 6 is a schematic cross-sectional view of the channel plate illustrating operation thereof according to the exemplary embodiment of the present invention.

FIG. 6 is a schematic cross-sectional view of the channel plate illustrating operation thereof.

When the surface of the channel plate 2 is polished, the surface of the partition to which pressure is applied is ground more. However, the wider the partition, the lower the pressure exerted in the polishing process. As a result, the partitions suffer less grinding.

Accordingly, as illustrated in FIG. 5, a thickness tb of the partition 505 of the dummy individual channel 503 that is ground in the polishing decreases as the width of the partition 505 becomes wider. Accordingly, the thickness tb gradually increases from a thickness ta to a thickness tc. It is noted that the thickness ta is the thickness of a partition 504 in the area 511 where the individual channels 502 are disposed, and the thickness tc is the thickness of the channel plate 2 of the area 513 where the dummy individual channel 503 is not formed.

When the channel plate 2 is bonded together with the nozzle plate 1 and the vibration plate 3, it is recognized from FIG. 6 that the thickness continuously changes from the area 511 of the individual channel 502 toward the area 513 where the dummy individual channel 503 is not formed, so that the nozzle plate 1 and the vibration plate 3 are seamlessly bonded. Such a structure eliminates bonding failure, thereby eliminating discharging failure and enabling constantly even liquid discharging.

In the exemplary embodiment described above, a width of a partition 505 between the individual channel 502 and the dummy individual channel 503 is the same as that of the partition 504 between the individual channels 502.

With this structure, because the property of each of the individual channels 502 can be set equal regardless of whether the individual channel 502 is at the end of the row or other than the end, discharge is uniform.

Figure 7:
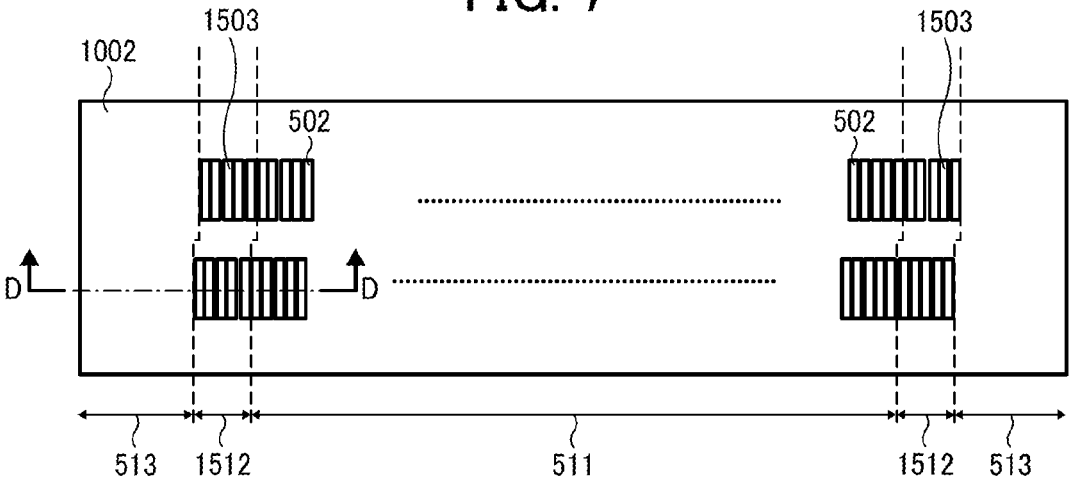
FIG. 7 is an explanatory plan view of a channel plate according to a comparative example.
Figure 8:
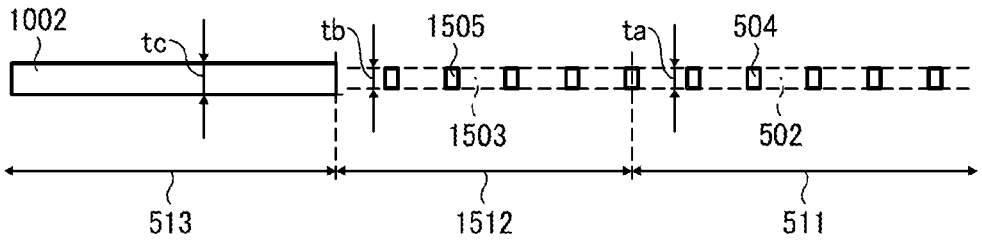
FIG. 8 is a cross-sectional view of the channel plate along a line D-D in FIG. 7.
Figure 9:
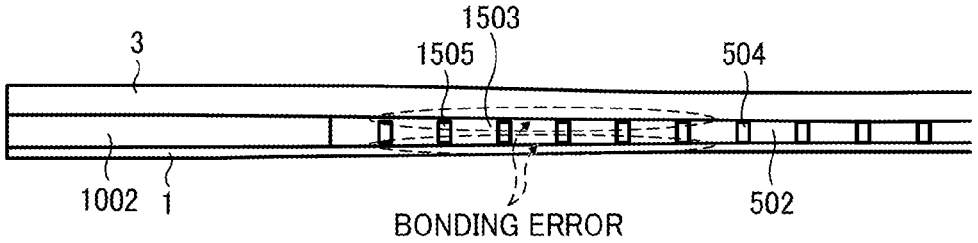
FIG. 9 is a cross-sectional view of the channel plate illustrating operation thereof according to the comparative example.

To further an understanding of the unique features of the present embodiment, a comparative example will be described with reference to FIGS. 7 to 9. FIG. 7 is an explanatory plan view of a channel plate 1002 according to a comparative example; FIG. 8 is a cross-sectional view of the channel plate along a line D-D in FIG. 7; and FIG. 9 is a cross-sectional view of the channel plate illustrating operation thereof according to the comparative example.

The channel plate 1002 according to the comparative example is configured such that the pitch of a plurality of dummy individual channels 1503 is the same and a width of each of a plurality of partitions 1505 is the same. In addition, the width of the partition 1505 is the same as that of the partition 504 in the individual channel 502.

In the channel plate 1002 according to the comparative example, the polished amount of the partition to which more pressure is applied increases as described above. Accordingly, the partition 504 in the area 511 where the individual channels 502 are disposed and the partition 1505 in an area 1512 where the dummy individual channels 1503 are disposed are polished more.

As a result, compared to the thickness tc of the area 513 at an end portion of the channel plate 1002 where the dummy individual channel 503 is not formed, the thicknesses to and tb of respective areas 511 and 1512 decreases, resulting in a difference in level between the area 513 and the area 1512.

As a result, when the channel plate 1002 according to the comparative example is bonded with the nozzle plate 1 and the vibration plate 3, a bonding failure occurs due to the difference in level in the area 1512 and at an end portion of the individual channel area 511, that is, the area circled by a broken line in FIG. 9. It can be said that a bonding failure occurs when the head using the channel plate according to the comparative example is used.

Figure 10:
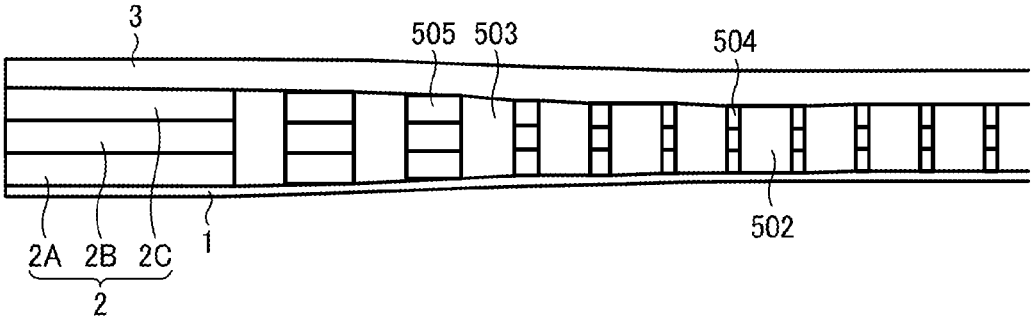
FIG. 10 is a schematic cross-sectional view of a liquid discharging head according to a second embodiment of the present invention.

FIG. 10 is a schematic cross-sectional view of the liquid discharging head according to a second embodiment of the present invention.

In the present embodiment, the channel plate 2 includes first to third channel plates 2A, 2B, and 2C, which are laminated in layers.

Even in a case where a plurality of plate members are bonded to form one channel plate 2, thicknesses of plate members continuously change and a head without bonding failure can be constructed, thereby eliminating the discharging failure and enabling stable discharging.

In the description above, a case in which the present invention is applied to a disposition of the individual channel 502 including the individual liquid chamber 6 is described; however, the present invention is also applicable to a case in which the dummy individual liquid channels alone are disposed outside the individual liquid chamber 6. When the individual liquid channel, the liquid resistor, and the liquid inlet are formed by press working, it is preferred that the dummy ones have the same shape.

Next, an example of an image forming apparatus including a liquid discharge head according to the second embodiment of the present invention will be described with reference to FIGS. 11 and 12.

Figure 11:
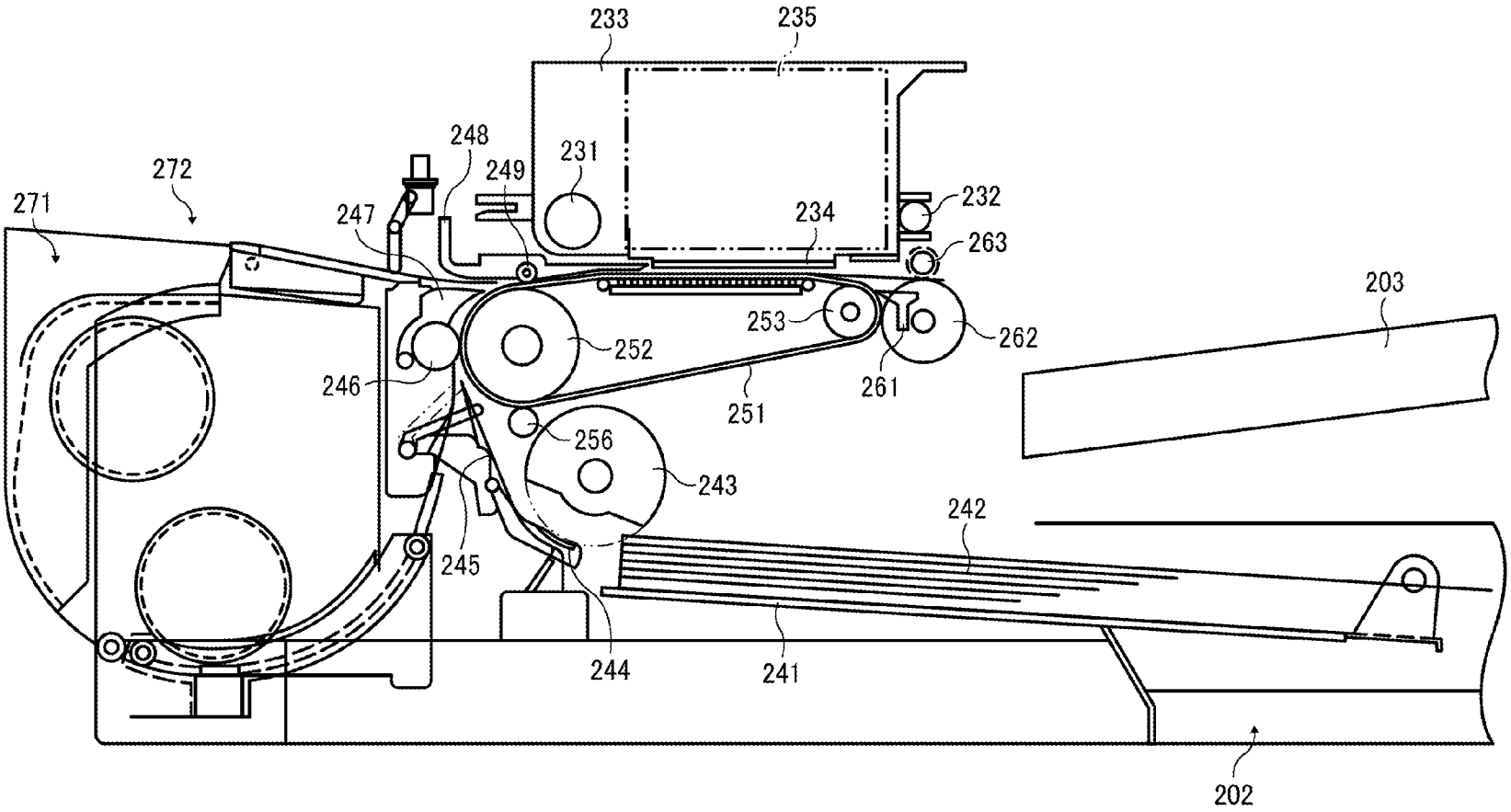
FIG. 11 is a cross-sectional side view of an image forming apparatus illustrating a mechanical configuration thereof according to the present invention.
Figure 12:
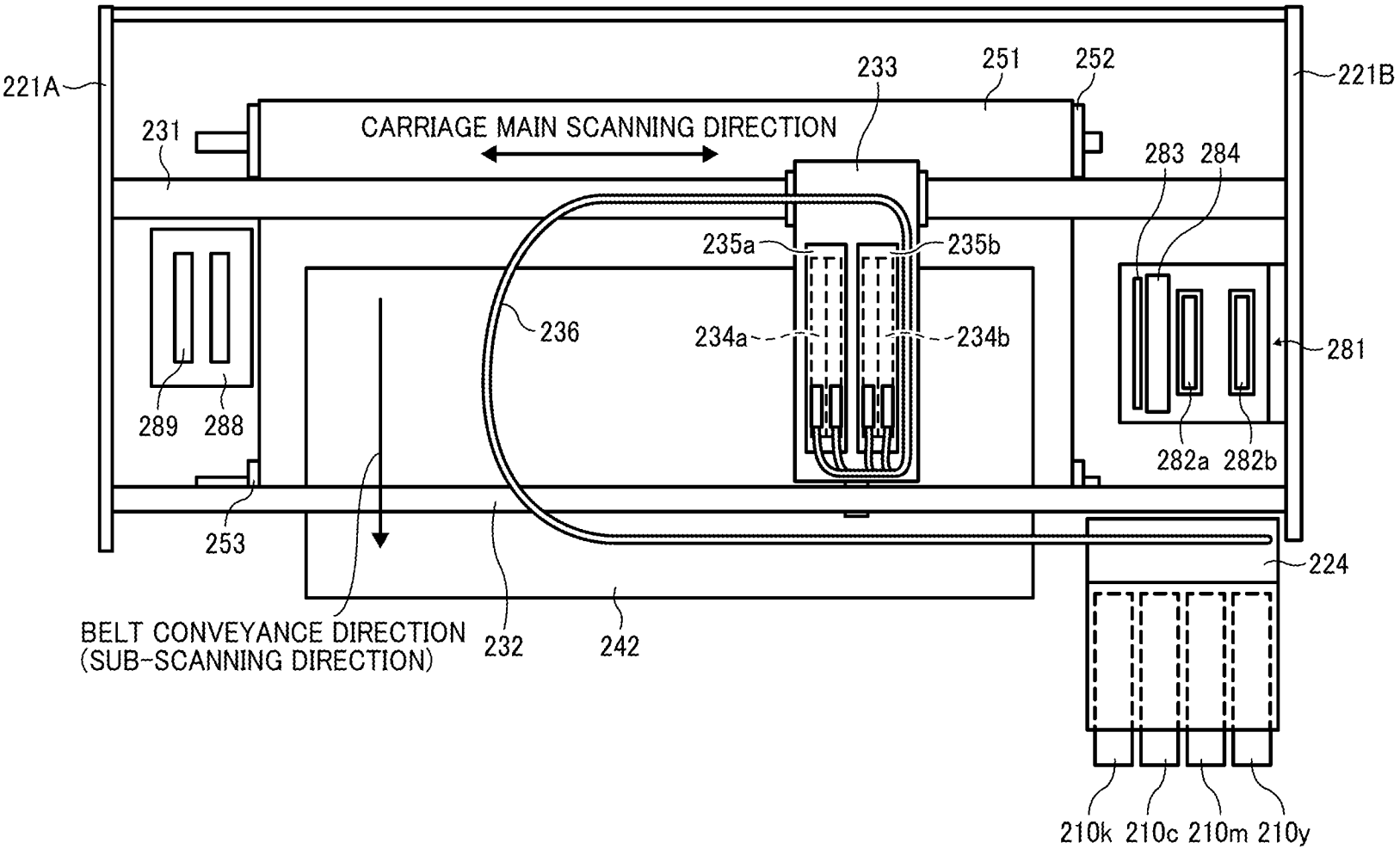
FIG. 12 is a plan view illustrating principal parts of the image forming apparatus.

FIG. 11 is a cross-sectional side view of an image forming apparatus illustrating a mechanical configuration thereof; and FIG. 12 is a plan view illustrating principal parts of the image forming apparatus.

This image forming apparatus is a serial-type image forming apparatus, including a main and auxiliary guide rods 231, 232 laterally held by side plates 221A, 221B, and a carriage 233 which is slidably held by the guide rods 231, 232 to be movable in a main scanning direction. The carriage 233 moves to scan in the main scanning direction of the carriage in an arrow direction driven by a main scanning motor via a timing belt.

Two recording heads 234*a*, 234*b* each formed of liquid discharging head according to the present invention to discharge ink droplets of respective colors, are mounted on the carriage 233. (Hereinafter, the recording heads may be referred to the recording head 234 collectively.) The recording heads 234 include nozzle arrays formed of a plurality of nozzles arranged in a sub-scanning direction perpendicular to the main scanning direction, with the ink droplet discharge trajectory oriented downward.

The recording heads 234 are formed of liquid discharging heads each having two nozzle arrays. One of the nozzle arrays of the recording head 234*a* discharges droplets of black (K) and the other discharges droplets of cyan (C). One of nozzle arrays of the other recording head 234*b* discharges droplets of magenta (M) and the other discharges droplets of yellow (Y), respectively. Herein, four colors of droplets are discharged using two heads, but it can be configured such that one head includes four nozzle arrays and four colors of droplets can be discharged from one head.

The carriage 233 includes sub tanks 235 (235*a*, 235*b*), which supply ink of respective colors corresponding to each nozzle array of the recording head 234. A supply unit 224 supplies ink of each color from ink cartridges 210 for each color via a supply tube 236 of each color to the sub tanks 235. There are provided four ink cartridges 210*k*, 210*c*, 210*m*, and 210*y* for the colors of black, cyan, magenta, and yellow.

There is provided a sheet feeding section from which sheets of paper 242 stacked on a sheet stacker (or a pressure plate) 241 of a sheet feed tray 202 are conveyed. The sheet feeding section includes a sheet feed roller or a semilunar roller 243 to separate and feed each sheet 242 from the sheet stacker 241 one by one and a separation pad 244 facing the sheet feed roller 243.

Then, to convey the sheet 242 supplied from the sheet feed section to the lower side of the recording head 234, a guide member 245 to guide the sheet 242, a counter roller 246, a conveyance guide member 247, and a pressure member 248 including an end press roller 249, are disposed. Further, a conveyance belt 251, which is a conveying means to electrostatically attract the fed sheet 242 and convey it at a position facing the recording head 234, is disposed.

This conveyance belt 251 is an endless belt stretching around a conveyance roller 252 and a tension roller 253, and is so configured as to rotate in a belt conveyance direction (i.e., a sub-scanning direction). In addition, a charging roller 256, which is a charging means to charge a surface of the conveyance belt 251, is provided. The charging roller 256 is disposed in contact with the surface layer of the conveyance belt 251 and is rotated driven by the rotation of the conveyance belt 251. The conveyance belt 251 is rotated in a belt conveyance direction by the rotation of the conveyance roller 252 driven by a sub-scanning motor, not shown.

Further, as a sheet ejection portion to eject the sheet 242 on which an image has been recorded by the recording head 234, a separation claw 261 to separate a sheet 242 from the conveyance belt 251, and sheet discharge rollers 262, 263, are disposed. A sheet discharge tray 203 is provided underneath the sheet discharge roller 262.

A duplex unit 271 is detachably provided at a backside of the apparatus body. This duplex unit 271 pulls in a sheet 242 which has been returned by a reverse rotation of the conveyance belt 251, reverses the sheet 242, and feeds the reversed sheet 242 again between the counter roller 246 and the conveyance belt 251. Further, an upper surface of the duplex unit 271 is used as a manual sheet feed tray 272.

Furthermore, a maintenance unit 281 including a recovery means to maintain the nozzles of the recording heads 234 in good condition is provided at a non-printing area at one side in the scanning direction of the carriage 233.

The maintenance unit 281 includes caps 282*a* and 282*b* (referred to collectively as a cap 282) to cap each nozzle surface of the recording heads 234. The maintenance unit 281 further includes a wiper blade 283, a blade member to wipe the nozzle surface. The maintenance unit 281 further includes a first dummy discharge receiver 284 to receive dummy-discharged droplets. The dummy discharge means a discharge of droplets to discharge agglomerated recording liquid not contributive to a normal recording operation.

A second dummy-discharge receiver 288 is disposed at a non-printing area at the other side in the scanning direction of the carriage 233. The second dummy-discharge receiver 288 receives droplets of dummy-discharged droplets performed to remove agglomerated recording liquid during printing operation. The second dummy-discharge receiver 288 includes an opening 289 along the nozzle array direction of the recording head 234.

In the thus-configured image forming apparatus, the sheets 242 are separated and fed one by one from the sheet feed tray 202, the sheet 242 fed upward in a substantially vertical direction is guided by the guide member 245, and is conveyed while being sandwiched between the conveyance belt 251 and a counter roller 246. The leading edge of the sheet 242 is then guided by the conveyance guide member 247, the sheet 242 is pressed against the conveyance belt 251 by the end press roller 249, and its direction is changed by 90 degrees.

When the sheet 242 is fed on the charged conveyance belt 251, the sheet 242 is attracted to the conveyance belt 251 and is conveyed in the sub-scanning direction by the cyclic rotation of the conveyance belt 251.

Then, the recording head 234 is driven in response to image signals while moving the carriage 233 to allow the head 234 to discharge ink droplets onto the stopped sheet 242 to record a single line. After the sheet 242 is conveyed by a predetermined amount, a next line is recorded. Upon receiving a recording end signal or a signal indicating that a trailing edge of the sheet 242 has reached the recording area, the recording operation is terminated and the sheet 242 is ejected to the sheet discharge tray 203.

As a result, because the image forming apparatus includes the liquid discharge head according to preferred embodiments of the present invention as a recording head, a high quality image is reliably formed.

In this patent specification, the term "sheet" is not limited to the paper material, but also includes an OHP sheet, fabrics, boards, etc., on which ink droplets or other liquid are deposited. The term "sheet" is a collective term for a recorded medium, recording medium, recording sheet, and the like. The term "image formation" means not only recording, but also printing, image printing, and the like.

The term "image forming apparatus" means an apparatus to perform image formation by jetting droplets to various media such as paper, thread, fiber, fabric, leather, metals, plastics, glass, wood, ceramics, and the like. "Image formation" means not only forming images with letters or figures having meaning to the medium, but also forming images without meaning such as patterns to the medium (and simply jetting the droplets to the medium).

The term "ink" is not limited to so-called ink, but means and is used as an inclusive term for every liquid such as recording liquid, fixing liquid, and aqueous fluid to be used for image formation, which further includes, for example, DNA samples, registration and pattern materials and resins.

The term "image" is not limited to a plane two-dimensional one, but also includes a three-dimensional one, and the image formed by three-dimensionally from the 3D figure itself.

Further, the image forming apparatus includes, otherwise limited in particular, any of a serial-type image forming apparatus and a line-type image forming apparatus.

The pressure generating means is not limited to the piezoelectric actuator, but may employ a thermal actuator that uses thermoelectric conversion elements such as a thermal resistor, and an electrostatic actuator formed of a vibration plate and an opposite electrode.

Additional modifications and variations of the present invention are possible in light of the above teachings. It is therefore to be understood that, within the scope of the appended claims, the invention may be practiced other than as specifically described herein.

What is claimed is:

1. A liquid discharging head, comprising:

a nozzle plate including a plurality of nozzles to discharge a liquid;

a channel plate including a plurality of individual liquid chambers disposed in a row and connected to the plurality of nozzles;

a wall-forming member to form a wall of the individual liquid chambers;

a plurality of dummy individual channels disposed on the channel plate along a nozzle alignment direction outside the outermost individual liquid chambers, in the nozzle alignment direction; and partitions between the dummy individual channels, wherein a width of the partitions between adjacent dummy individual channels along the nozzle alignment direction increases away from the outermost individual liquid chambers.

2. The liquid discharging head as claimed in claim 1, wherein a pitch between adjacent dummy individual channels widens away from the outermost individual liquid chambers.

3. The liquid discharging head as claimed in claim 1, wherein a width of a first partition between the individual channel and the dummy individual channel is the same as the width of a second partition between the individual channels.

4. The liquid discharging head as claimed in claim 1, further comprising an area of the channel plate where the dummy individual channels are not formed.

5. An image forming apparatus comprising a liquid discharging head, the liquid discharging head, including a nozzle plate including a plurality of nozzles to discharge a liquid, a channel plate including a plurality of individual liquid chambers disposed in a row and connected to the plurality of nozzles, a wall-forming member to form a wall of the individual liquid chambers, a plurality of dummy individual channels disposed on the channel plate along a nozzle alignment direction outside the outermost individual liquid chambers, in the nozzle alignment direction, and partitions between the dummy individual channels, wherein a width of the partitions between adjacent dummy individual channels along the nozzle alignment direction increases away from the outermost individual liquid chambers.

* * * * *